United States Patent [19]

Nakamura

[11] Patent Number: 4,799,363

[45] Date of Patent: Jan. 24, 1989

[54] ROOM AIR CONDITIONER

[75] Inventor: Takashi Nakamura, Wakayama, Japan

[73] Assignee: Mitsubishi Denki Kabushiki Kaisha, Japan

[21] Appl. No.: 168,534

[22] Filed: Mar. 8, 1988

Related U.S. Application Data

[63] Continuation of Ser. No. 71,077, Jul. 8, 1987, abandoned.

[30] Foreign Application Priority Data

Jul. 17, 1986 [JP] Japan ..... 61-168405

[51] Int. Cl.[4] ..... F25B 13/00

[52] U.S. Cl. ..... 62/160; 62/324.1

[58] Field of Search ..... 62/324.1, 160, 503

[56] References Cited

U.S. PATENT DOCUMENTS

| | | | |
|---|---|---|---|
| 2,512,869 | 6/1950 | McBroom | 62/503 X |
| 2,570,979 | 10/1951 | Phillips | 62/503 X |
| 2,778,195 | 1/1957 | Christensen | 62/503 X |
| 3,264,837 | 8/1966 | Harnish | 62/324.1 X |
| 3,423,954 | 1/1969 | Harnish et al. | 62/324.1 X |
| 4,102,390 | 7/1978 | Harnish et al. | 62/324.1 X |
| 4,137,725 | 2/1979 | Martin | 62/324.1 X |
| 4,266,405 | 5/1981 | Trask | 62/160 |
| 4,423,603 | 1/1984 | Oguni et al. | 62/324.1 |
| 4,563,879 | 1/1986 | Hama et al. | 62/160 |

FOREIGN PATENT DOCUMENTS 59-5817 2/1984 Japan .

*Primary Examiner*—Lloyd L. King

*Attorney, Agent, or Firm*—Leydig, Voit & Mayer

[57] ABSTRACT

A room air conditioner has a by-pass connected between return piping and liquid-side piping. A solenoid valve which opens and closes the by-pass and a heat exchanger are installed in the by-pass. The heat exchanger performs heat exchange between liquid refrigerant in the by-pass and high-temperature gaseous refrigerant which is discharged from a compressor. During defrosting operation, a controller opens the solenoid valve to enable liquid refrigerant to flow through the by-pass. The liquid refrigerant in the by-pass is evaporated in the heat exchanger, and the mass flow rate of gaseous refrigerant through the air conditioner during defrosting operation is increased, thereby decreasing the time required for defrosting.

10 Claims, 2 Drawing Sheets

ROOM AIR CONDITIONER

This application is a continuation of application Ser. No. 071,077 filed July 8, 1987, now abandoned.

BACKGROUND OF THE INVENTION

This invention relates to a room air conditioner, and more particularly to a room air conditioner having improved defrosting performance.

During heating operation of a room air conditioner, frost forms on the coils of the outdoor heat exchanger of the air conditioner. As this frost reduces the performance of the heat exchanger, it is conventional to periodically carry out defrosting in which refrigerant is circulated through the air conditioner in the same direction as during cooling operation. Namely, high-temperature, high-pressure gaseous refrigerant which is discharged from the compressor is passed through the outdoor heat exchanger, where it melts the frost formed on the coils thereof. When the frost has been melted, the direction of circulation of the refrigerant is reversed, and the air conditioner returns to normal heating operation.

FIG. 1 is a schematic diagram of a conventional room air conditioner of the type to which the present invention relates. During defrosting operation, as shown by the arrows, high-temperature, high-pressure gaseous refrigerant is discharged from a compressor 1 and enters an outdoor heat exchanger 4 via discharge piping 2 and a four-way valve 3. The refrigerant melts frost which is formed on the coils of the outdoor heat exchanger 4 and in the process is condensed. It then flows through a check valve 6 which is connected in parallel with an expansion device 5 for heating operation in the form of a capillary tube, through liquid-side piping 7, and an expansion device 8 for cooling operation in the form of another capillary tube which is connected in parallel with a check valve 9. In the expansion device 8, the refrigerant is reduced in pressure and then flows through an indoor heat exchanger 10, where it is partially vaporized. From the indoor heat exchanger 10, it flows through gas-side piping 11, the four-way valve 3, return piping 12, and an accumulator 13, from which the gaseous portion of the refrigerant is sucked back into the compressor 1 to complete a cycle.

During defrosting operation, the indoor heat exchanger 10 of the air conditioner serves as an evaporator. In order to prevent cold air from being blown into the room which is being heated, an unillustrated indoor blower for the indoor heat exchanger 10 is turned off during defrosting. However, because the indoor blower is turned off, very little exchange of heat takes place in the indoor heat exchanger 10, and there is little vaporization of the low-temperature, low-pressure two-phase mixture of refrigerant passing therethrough so that much of the refrigerant which passes through the indoor heat exchanger 10 remains in a liquid state and ends up accumulating in the accumulator 13. This produces a fall in the pressure on the suction side of the compressor 1 and a decrease in the mass flow rate of gaseous refrigerant through the air conditioner. With a reduced flow rate, defrosting requires a long time, during which time the room temperature may fall to uncomfortable levels.

Furthermore, as the refrigerant which is discharged from the compressor 1 is in a superheated state, there is a great amount of heat loss to the atmosphere through the connecting piping between the discharge side of the compressor 1 and the outdoor heat exchanger 4. This lost heat in no way contributes to defrosting.

SUMMARY OF THE INVENTION

Accordingly, it is an object of the present invention to provide a room air conditioner which can perform defrosting operation more rapidly and more efficiently than a conventional room air conditioner.

In a room air conditioner in accordance with the present invention, a by-pass is provided between return piping for leading refrigerant to an accumulator and liquid-side piping. The by-pass is equipped with a solenoid valve which opens and closes the by-pass and a heat exchanger which performs heat exchange between liquid refrigerant in the by-pass and gaseous refrigerant in the discharge piping of the compressor. The solenoid valve is controlled by a controller which opens the solenoid valve during defrosting operation so that liquid refrigerant can flow through the by-pass and closes the solenoid valve at other times.

During defrosting operation, liquid refrigerant passes through the by-pass and is evaporated by heat exchange with high-temperature gaseous refrigerant in the discharge piping of the compressor. The gaseous refrigerant in the by-pass is then returned to the compressor via the accumulator. As a result, the pressure on the suction side of the compressor and the mass flow rate of gaseous refrigerant which circulates through the air conditioner are increased, so that the time required for defrosting can be decreased.

BRIEF DESCRIPTION OF THE DRAWINGS

In the figures, the same reference numerals indicate the same or corresponding parts.

DESCRIPTION OF THE PREFERRED EMBODIMENTS

Figure 1:
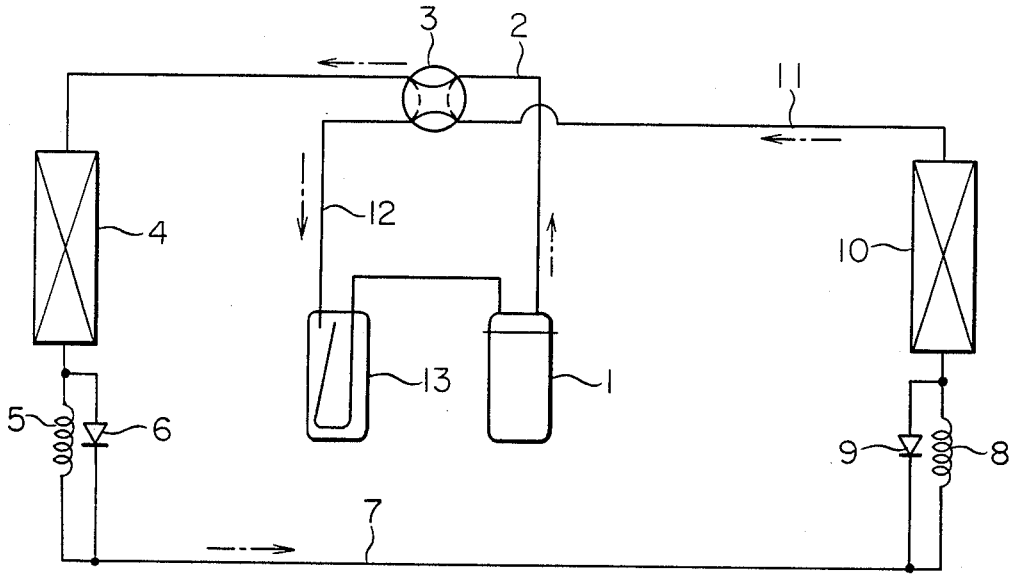
FIG. 1 PRIOR ART
FIG. 1 is a schematic diagram of a conventional room air conditioner.
Figure 2:
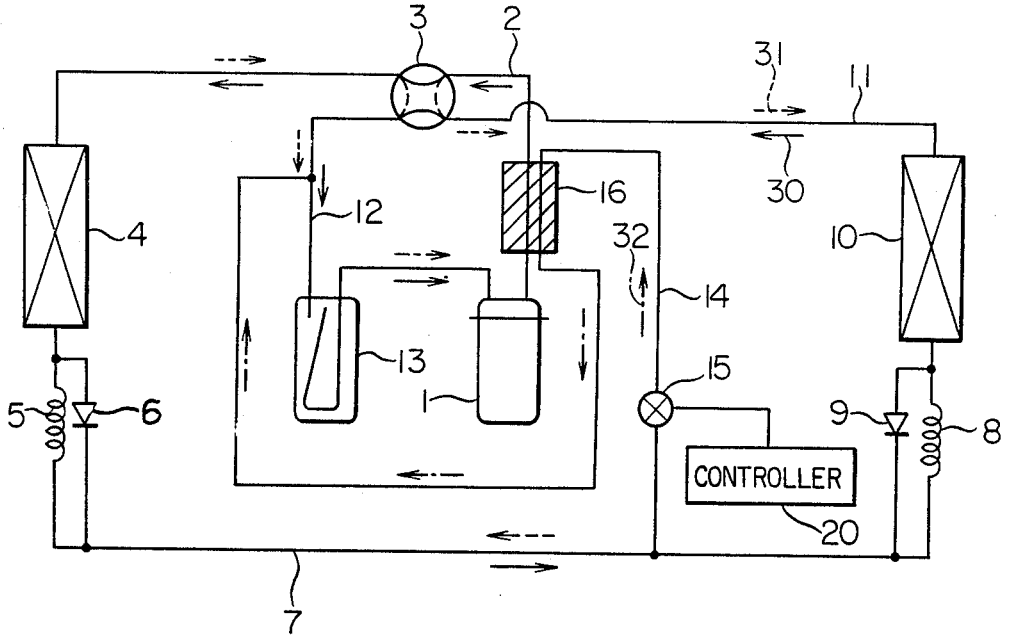
FIG. 2 is a schematic diagram of an embodiment of a room air conditioner in accordance with the present invention.

Hereinbelow, an embodiment of a room air conditioner in accordance with the present invention will be described while referring to the accompanying drawings. As shown in FIG. 2, which is a schematic diagram of this embodiment, an air conditioner in accordance with the present invention has generally the same structure as the conventional air conditioner of FIG. 1, but it further comprises a by-pass 14, a solenoid valve 15, a heat exchanger 16, and a controller 20 for the solenoid valve 15. The by-pass 14 is connected between return piping 12 and liquid-side piping 7 which connects two expansion devices 5 and 8. The solenoid valve 15 is installed along the by-pass 14 so as to open and close the by-pass 14 to liquid refrigerant from the liquid-side piping 7. The heat exchanger 16 is installed on the by-pass 14 so as to perform heat exchange between liquid refrigerant which passes through the by-pass 14 and high-temperature gaseous refrigerant which is discharged from the compressor 1 and passes through discharge piping 2. The controller 20 controls the operation of the solenoid valve 15, opening it during defrosting operation and closing it at other times.

Figure 3:
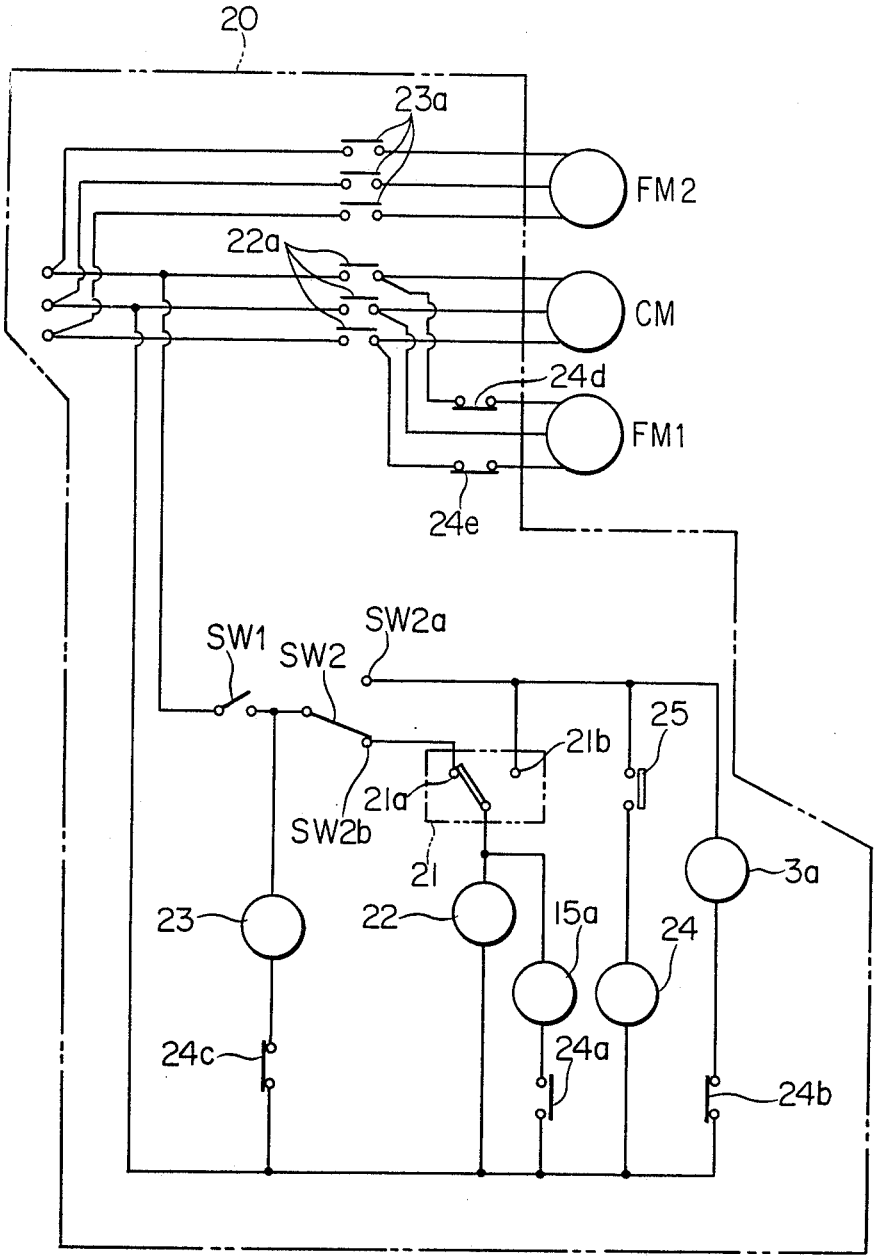
FIG. 3 is a circuit diagram of the controller of the embodiment of FIG. 2.

The structure of the controller 20 is illustrated schematically in FIG. 3. An operating switch SW1 is connected in series to a selector switch SW2 for switching between heating and cooling operation. The selector switch SW2 has two contacts SW2*a* and SW2*b*. The contact SW2*a* is closed during heating operation and contact SW2*b* is closed during cooling operation. The contacts SW2*a* and SW2*b* are respectively connected to contacts 21*a* and 21*b* of a thermoswitch 21 which is responsive to the temperature of the room in which the air conditioner is installed. The contact 21*a* is closed when the room temperature rises above a prescribed temperature, and the contact 21*b* is closed when the room temperature falls below the prescribed temperature. A contactor coil 23 of an unillustrated contactor is connected to the operating switch SW1 so as to be energized when the operating switch SW1 is closed. The contactor coil 23 operates three contacts 23*a* which are connected between an unillustrated power supply and an indoor fan motor FM2 which drives the unillustrated blower of the indoor heat exchanger 10. The contacts 23*a* are open when the contactor coil 23 is not energized and are closed when it is energized.

The thermoswitch 21 is connected to a contactor coil 22 of another unillustrated contactor. The contactor coil 22 operates three contacts 22*a* which are closed when the contactor coil 22 is energized and are open when it is not energized. These contacts 22*a* are connected between the unillustrated power supply and the compressor motor CM of the compressor 1 so as to be able to return it on and off. The solenoid valve 15 has a coil 15*a* which is connected to the thermoswitch 21 in parallel with the contactor coil 22. The solenoid valve 15 is opened when the coil 15*a* is energized and is closed when it is not energized.

An auxiliary relay 24 and a thermostat switch 25 of an unillustrated thermostat for defrosting operation are connected in series to contact SW2*a* of the selector switch SW2, and the coil 3*a* of the four-way valve 3 is connected in parallel therewith. The thermostat switch 25 opens when the temperature rises above a prescribed level and closes when the temperature falls below the prescribed level. The closing of the thermostat switch 25 energizes the auxiliary relay 24, which has five contacts 24*a*–24*e*. The contact 24*a* is connected in series with the solenoid valve coil 15*a*, the contact 24*b* is connected in series with the four-way valve coil 3*a*, the contact 24*c* is connected in series with the contactor coil 23, and the contacts 24*d* and 24*e* are connected between the power supply and an outdoor fan motor FM1 which drives a blower for the outdoor heat exchanger 4. When the auxiliary relay 24 is energized, the contact 24*a* is closed and the other four contacts 24*b*–24*e* are opened, while when it is not energized, the contact 24*a* is opened and the other four contacts are closed. When the coil 3*a* of the four-way valve 3 is energized, the four-way valve 3 is turned to the position for heating operation as shown the the dashed lines in FIG. 2, and when the coil 3*a* is not energized, the four-way valve 3 is turned to the position for cooling or defrosting operation as shown by the solid lines.

The operation of the controller 20 during heating operation is as follows. When the operating switch SW1 is closed, the contactor coil 23 is energized and it closes the contacts 23*a*, causing the indoor fan motor FM2 to start. If the selector switch SW2 is set to heating operation (in which case contact SW2*a* is closed), the coil 3*a* of the four-way valve 3 is energized, and the four-way valve 3 is turned to the position for heating operation. If the room temperature is below a prescribed level, then the contact 21*b* of the thermoswitch 21 is closed, and so the contactor coil 22 will be energized. As a result, the contacts 22*a* will close, and the compressor motor CM and the outdoor fan motor FM1 will start.

When the temperature detected by the thermostat falls below a prescribed level, the thermostat switch 25 closes to initiate defrosting operation. The closing of the thermostat switch 25 energizes the auxiliary relay 24, which closes the contact 24*a* and opens the contacts 24*b*–24*e*. When the contact 24*b* opens, the coil 3*a* of the four-way valve 3 is de-energized, and the four-way valve 3 is turned to the position for defrosting operation, which is the same as for cooling operation and is indicated by the solid lines in FIG. 2. At the same time, the closing of the contact 24*a* energizes coil 15*a* and opens the solenoid valve 15, the opening of contact 24*c* de-energizies the contactor coil 23 and stops the indoor fan motor FM2, and the opening of the contacts 24*d* and 24*e* stops the outdoor fan motor FM1. The opening of the solenoid valve 15 enables refrigerant to flow through the by-pass 14. When the temperature detected by the thermostat rises above the prescribed level, the thermostat switch 25 again opens, and operation returns to normal heating operation.

The flow of refrigerant during heating and defrosting operation of the embodiment illustrated in FIG. 2 will now be explained. In FIG. 2, the solid arrows 30 indicate the flow of refrigerant during cooling, the dashed arrows 31 indicate refrigerant flow during heating, and the arrows 32 with the long and short dashes indicate refrigerant flow through the by-pass 14 during defrosting operation.

During heating operation, high-temperature, high-pressure gaseous refrigerant which is discharged from the compressor 1 passes through the discharge piping 2, the heat exchanger 16, the four-way valve 3, and the gas-side piping 11 and enters the indoor heat exchanger 10. In the indoor heat exchanger 10, it is condensed and becomes high-temperature, high-pressure liquid refrigerant. The refrigerant then passes through the check valve 9 and enters the liquid-side piping 7. During heating operation, the solenoid valve 15 is closed, so all the refrigerant passes through the expansion device 5 for heating in which it is reduced in pressure, after which it enters the outdoor heat exchanger 4 and is evaporated. From the outdoor heat exchanger 4, it passes through the four-way valve 3, the return piping 12, and the accumulator 13 and returns to the compressor 1.

When the temperature sensed by the thermostat falls below a prescribed level, the thermostat switch 25 closes, and the controller 20 opens the solenoid valve 15 and turns the four-way valve 3 to the position shown by the solid lines for defrosting operation. As a result, the high-temperature, high-pressure gaseous refrigerant which is discharged from the compressor 1 passes through the heat exchanger 16 and exchanges heat with liquid refrigerant within the by-pass 14. The degree of superheat of the gaseous refrigerant entering the heat exchanger 16 from the compressor 1 is decreased and it is cooled to near a saturated vapor state. From the heat exchanger 16, the gaseous refrigerant passes through the four-way valve 3 to the outdoor heat exchanger 4, where it defrosts the coils of the outdoor heat exchanger 4 and is condensed. It then passes through the check valve 6 and the liquid-side piping 7. A portion of this liquid refrigerant passes through the expansion device 8 where it is reduced in pressure and passes through the indoor heat exchanger 10, the gas-side piping 11, the four-way valve 3, and the return piping 12 and enters the accumulator 13. The remainder of the liquid refrigerant within the liquid-side piping 7 flows into the by-pass 14 through the open solenoid valve 15 and undergoes heat exchange in the heat exchanger 16 with the high-temperature gaseous refrigerant from the compressor 1. In the heat exchanger 16, the liquid refrigerant is evaporated and then flows into the accumulator 13 via the return piping 12 onto which the by-pass 14 opens. In the accumulator 13, the low-pressure, two-phase refrigerant which passed through the indoor heat exchanger 10 is mixed with the gaseous refrigerant from the by-pass 14, which is at a relatively high temperature and pressure. The mixture of the gaseous refrigerant from the two sources, which is at an intermediate pressure, is then returned to the compressor 1.

As a result, the specific volume of the gaseous refrigerant entering the compressor 1 is decreased, and the pressure on the suction side of the compressor 1 is increased. The mass flow rate of gaseous refrigerant through the air conditioner is therefore increased in comparison to a conventional air conditioner, and due to the increased flow rate, the outdoor heat exchanger 4 can be more quickly defrosted. This results in increased comfort for the user of the air conditioner since heating can be performed for a greater percentage of operating time. Furthermore, as the temperature of the gaseous refrigerant which is discharged from the compressor 1 is reduced in the heat exchanger 16, there is less wasteful heat loss to the atmosphere as the refrigerant flows between the compressor 1 and the outdoor heat exchanger 4.

What is claimed is:

1. A room air conditioner comprising:

a compressor having a suction side and a discharge side;

an accumulator having an intake side and a discharge side which is connected to the suction side of said compressor;

an outdoor heat exchanger having a gas side and a liquid side;

an indoor heat exchanger having a gas side and a liquid side;

liquid-side piping connected between the liquid side of said outdoor heat exchanger and the liquid side of said indoor heat exchanger;

discharge piping having one end connected to the discharge side of said compressor;

return piping having one end connected to the intake side of said accumulator;

a change-over valve connected to the other end of said return piping, to the other end of said discharge piping, to the gas side of said outdoor heat exchanger, and to the gas side of said indoor heat exchanger, said change-over valve being adapted to be switched between a cooling and defrosting setting in which the discharge side of said compressor communicates with said outdoor heat exchanger and the intake side of said accumulator communicates with said indoor heat exchanger, and a heating setting in which the discharge side of said compressor communicates with said indoor heat exchanger and the intake side of said accumulator communicates with said outdoor heat exchanger;

a by-pass for connecting said liquid-side piping with the intake side of said accumulator;

valve means disposed in said by-pass;

a heat exchanger disposed in said bypass and said discharge piping so as to be able to perform heat exchange therebetween; and controller comprising first means for opening said valve means during defrosting operation and closing it at other times.

2. A room air conditioner as set forth in claim 1, wherein said valve means comprises a solenoid valve.

3. A room air conditioner as set forth in claim 1, wherein said change-over valve comprises a four-way valve.

4. A room air conditioner as set forth in claim 1, further comprising:

a first throttle mechanism for cooling which is connected in series with said indoor heat exchanger on the liquid side thereof; and a second throttle mechanism for heating which is connected in series with said outdoor heat exchanger on the liquid side thereof.

5. A room air conditioner as set forth in claim 4, further comprising:

a first check valve connected between the liquid side of said indoor heat exchanger and said liquid-side piping in parallel with said first throttle mechanism; and a second check valve connected between the liquid side of said outdoor heat exchanger and said liquid-side piping in parallel with said second throttle mechanism.

6. A room air conditioner as set forth in claim 1 wherein said controller further comprises second means for switching said change-over valve between the cooling and defrosting setting and the heating setting.

7. A room air conditioner as set forth in claim 6 wherein said compressor comprises a compressor motor and said controller further comprises third means for turning the compressor motor on and off.

8. A room air conditioner as set forth in claim 6 wherein said indoor heat exchanger comprises a blower driven by an indoor fan motor and said controller further comprises fourth means for turning the indoor fan motor on during heating operation and off at other times.

9. A room air conditioner as set forth in claim 6 wherein said outdoor heat exchanger comprises a blower driven by an outdoor fan motor, and said controller further comprises fifth means for turning the outdoor fan motor on and off.

10. A room air conditioner as set forth in claim 1 wherein said outdoor heat exchanger comprises coils, said room air conditioner further comprising:

a thermoswitch disposed so as to be responsive to the temperature of a room in which the room air conditioner is installed; and a thermostat switch disposed so as to be responsive to the temperature at the coils of the outdoor heat exchanger.

* * * * *